US007412968B2

(12) United States Patent
Takayanagi et al.

(10) Patent No.: US 7,412,968 B2
(45) Date of Patent: Aug. 19, 2008

(54) FUEL SUPPLY APPARATUS FOR ENGINE AND CONTROL METHOD OF SAME APPARATUS

(75) Inventors: Keiichi Takayanagi, Isesaki (JP); Junichi Furuya, Isesaki (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 11/790,795

(22) Filed: Apr. 27, 2007

(65) Prior Publication Data

US 2007/0251502 A1 Nov. 1, 2007

(30) Foreign Application Priority Data

Apr. 28, 2006 (JP) ..... 2006-124798

(51) Int. Cl.
*F02M 69/46* (2006.01)
*F02M 69/50* (2006.01)

(52) U.S. Cl. ..... 123/456; 123/198 D

(58) Field of Classification Search ..... 123/456, 123/446, 447, 457, 459, 463, 464, 495, 359, 123/506, 511, 514, 198 D
See application file for complete search history.

(56) References Cited

U.S. PATENT DOCUMENTS

| | | | | |
|---|---|---|---|---|
| 5,937,826 | A * | 8/1999 | Olson et al. | 123/447 |
| 6,053,147 | A * | 4/2000 | Hemmerlein et al. | 123/447 |
| 6,234,148 | B1 * | 5/2001 | Hartke et al. | 123/447 |
| 6,293,251 | B1 * | 9/2001 | Hemmerlein et al. | 123/447 |
| 6,557,530 | B1 * | 5/2003 | Benson et al. | 123/480 |
| 7,007,676 | B1 * | 3/2006 | Schuricht et al. | 123/479 |

FOREIGN PATENT DOCUMENTS

| | | | |
|---|---|---|---|
| DE | 19800760 | * | 8/1998 |
| JP | 2000-511992 | | 9/2000 |
| WO | WO 99/45260 | | 9/1999 |

* cited by examiner

*Primary Examiner*—Mahmoud Gimie
(74) *Attorney, Agent, or Firm*—Foley & Lardner LLP

(57) ABSTRACT

In a fuel supply apparatus for an engine, which is provided with a relief valve for returning fuel in a fuel pipe into a fuel tank when a fuel pressure exceeds a threshold, and also feedback controls a discharge amount of a fuel pump so that the fuel pressure detected by a pressure sensor approaches a target pressure, when the pressure sensor is failed, a duty of a PWM signal for the fuel pump is fixedly maintained at a predetermined value, and fuel injection pulse width is calculated on the assumption that the fuel pressure is held at the threshold.

16 Claims, 7 Drawing Sheets

FUEL SUPPLY APPARATUS FOR ENGINE AND CONTROL METHOD OF SAME APPARATUS

BACKGROUND OF THE INVENTION

1. Field of the Invention

The present invention generally relates to a fuel supply apparatus for an engine, having at least a fuel injection valve for injecting fuel into the engine, a fuel tank for storing fuel, a fuel pump for discharging fuel from the fuel tank via a fuel pipe, a pressure sensor detecting a fuel pressure in the fuel pipe, a relief valve capable of returning the fuel from the fuel pipe to the fuel tank depending on the fuel pressure prevailing in the fuel pipe, and a control unit for controlling operation, and also to a control method for the fuel supply apparatus. More, particularly, the present invention relates to technique which is contrived to control the fuel pump so as to perform feedback control of discharging operation of the fuel pump when an abnormal operation state, e.g., a failure, occurs in the pressure sensor.

2. Description of the Related Art

Japanese Patent National Publication of Translated Version No. 2000-511992 discloses a fuel supply apparatus for an engine, in which a fuel pump is activated based on both a fuel pressure detected by a pressure sensor and a reference pressure, and in which, in the case where an abnormality in the pressure sensor is detected, the fuel pump is adjustably operated based on both a required engine fuel amount and an engine rotating speed.

As described in the above, in the case where the fuel pump is operated based on both the required engine fuel amount and the engine rotating speed an amount of fuel which corresponds to the amount of consumption of fuel in the engine is discharged from the fuel pump.

Therefore, in the case where a pump controlling is shifted to that based on both the required engine fuel amount and the engine rotating speed under a state where the fuel pressure is converged to the vicinity of a target fuel pressure, it is possible to maintain the fuel pressure in the vicinity of the target fuel pressure.

Nevertheless, in the case where the pump controlling is shifted to that based on both the required engine fuel amount and the engine rotating speed during a process in which the fuel pressure is increased up to the vicinity of the target fuel pressure, since the amount of fuel corresponding to the consumption amount of fuel in the engine is replenished, it is impossible to increase the fuel pressure up to the vicinity of the target fuel pressure, and further, the fuel pressure becomes inconsistent.

Accordingly, when an abnormality or a trouble occurs in the pressure sensor during the process of increasing the fuel pressure, the control accuracy of an injection amount to the engine by a fuel injection valve is significantly lowered and an air-fuel ratio becomes excessively leaner, so that, sometimes, the engine operating stability is largely degraded.

SUMMARY OF THE INVENTION

Therefore, the present invention has an object to make it possible to continue the fuel supply to an engine even if a pressure sensor incorporated in the fuel supply apparatus falls in an abnormal operation state due to trouble, failure or the like, and also to avoid that an air-fuel ratio becomes significantly leaner.

According to one aspect of the present invention, there is provided a fuel supply apparatus for an engine, which comprises: a fuel injection valve for injecting fuel to the engine; a fuel tank reserving the fuel for the engine; a fuel pump for supplying the fuel to the fuel injection valve via a fuel pipe: a relief valve for returning the fuel in the fuel pipe to the fuel tank when a pressure in the fuel pipe exceeds a threshold; a pressure sensor for detecting a pressure of the fuel in the fuel pipe; and a control unit that inputs thereto a signal from the pressure sensor to output therefrom a manipulated variable for the fuel pump, wherein the control unit determines whether the pressure sensor is in a normal operation state or in an abnormal operation state;

when the pressure sensor is determined to be in the normal operation state, the control unit calculates the manipulated variable so that the fuel pressure detected by the pressure sensor approaches a target pressure; and when the pressure sensor is determined to be in the abnormal state, the control unit fixedly maintains the manipulated variable at a manipulated variable set beforehand therein.

According to another aspect of the present invention, there is provided a control method of a fuel supply apparatus for an engine, which is provided with a fuel pump for supplying fuel from a fuel tank to a fuel injection valve via a fuel pipe; a relief valve capable of returning the fuel in the fuel pipe into the fuel tank when a pressure prevailing in the fuel pipe exceeds a threshold; and a pressure sensor configured to detect a pressure of the fuel in the fuel pipe, and which comprises the steps of:

determining whether or the pressure sensor is in a normal operation state or in an abnormal operation state;

calculating, when the pressure sensor is determined to be in the normal operation state, a manipulated variable for the fuel pump, which allows the fuel pressure detected by the pressure sensor to approach a target pressure, thereby outputting the calculated manipulated variable to the fuel pump;

fixedly maintaining, when the pressure sensor is determined to be in the abnormal operation state, a manipulated variable for the fuel pump at a predetermined manipulated variable set beforehand, thereby outputting the maintained manipulated variable to the fuel pump.

The above and other objects, features and advantages of this invention will become understood from the following description with reference to the accompanying drawings.

DESCRIPTION OF THE PREFERRED EMBODIMENTS

Figure 1:
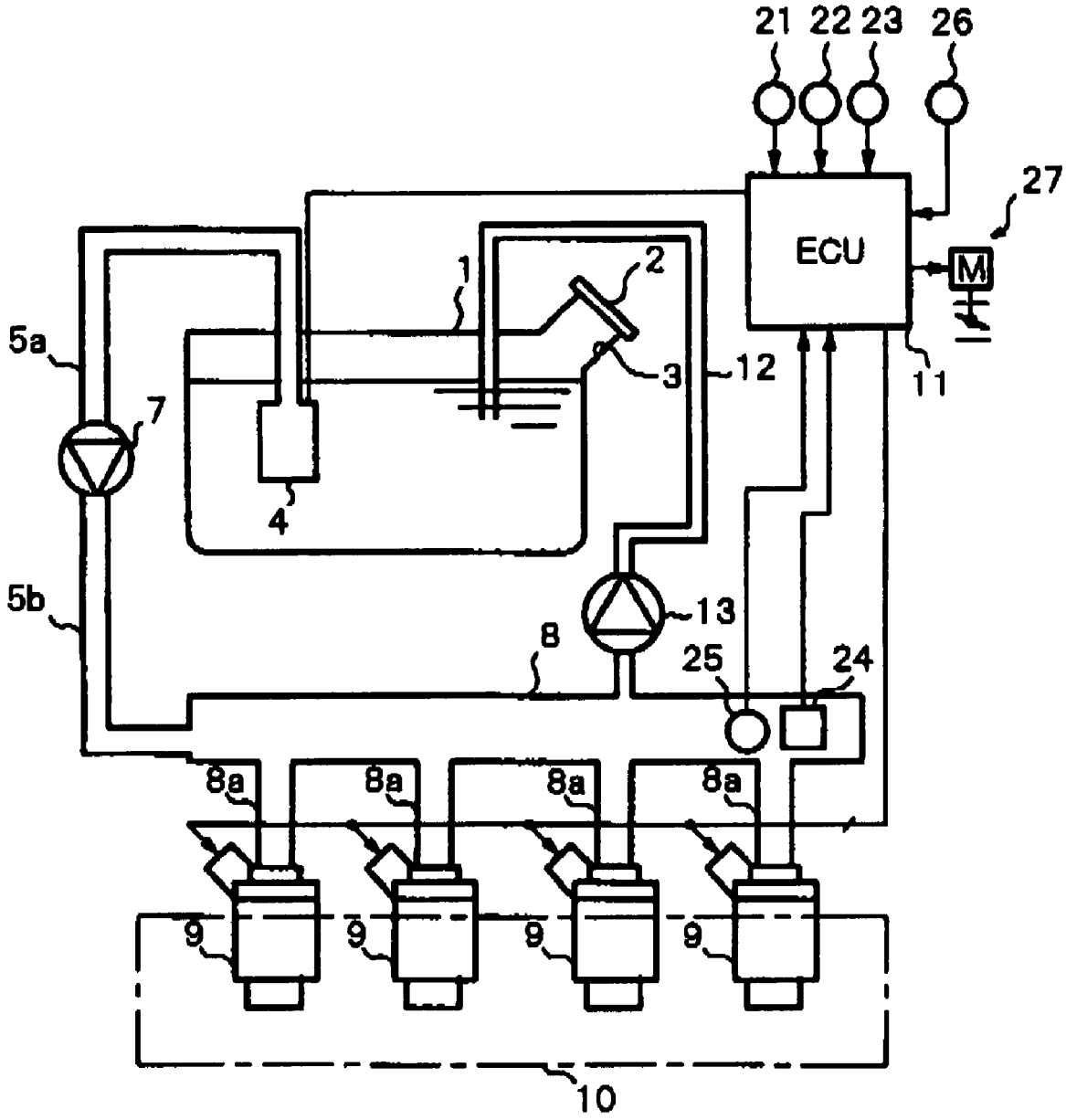
FIG. 1 is a view illustrating a structural constitution of a fuel supply apparatus according to an embodiment of the present invention.

FIG. 1 is a view showing a fuel supply apparatus for a vehicle engine according to the present invention.

In FIG. 1, a fuel tank 1 reserves fuel for an engine (internal combustion engine) 10.

A fuel filler opening 3 is formed on fuel tank 1 to be opened, which is to be sealed by means of a filler cap 2.

To the inside of fuel tank 1, a motorized fuel pump 4 is disposed,

Fuel pump 4 is a turbine type pump, and a discharge port of fuel pump 4 is connected to one end of a fuel pipe 5*a* is.

A check valve 7 is a one-way valve for stopping the fuel flowing from fuel injection valves 9 to fuel pump 4, and the other end of fuel pipe 5*a* is connected to an inlet port of check valve 7.

An outlet port of check valve 7 is connected to one end of a fuel pipe 5*b*, and the other end of fuel pipe 5*b* is connected to a fuel gallery pipe 8.

Fuel pipe 5*a*, fuel pipe 5*b* and fuel gallery pipe 8 forms fuel piping connecting between fuel pump 4 and fuel injection valves 9.

To fuel gallery pipe 8, there are disposed connecting portions 8*a* of the number same as the number of cylinders along an extending direction of fuel gallery pipe 8, and fuel inlet ports of fuel injection valves 9 are respectively connected to connecting portions 8*a*.

With regard to each of fuel injection valves 9, when a magnetic attractive force is generated due to supply of electric excitation current to an electromagnetic coil, each valve body thereof having been urged toward a valve closing direction by a spring is inversely lifted up by the magnetic attractive force to perform injection.

Fuel injection valves 9 are respectively disposed to intake port portions of the respective cylinders of engine 10, to inject the fuel to the respective cylinders.

Further, there is disposed a relief pipe 12 which communicates the inside of fuel gallery pipe 8 with the inside of fuel tank 1, and a relief valve 13 is disposed on a halfway portion of relief pipe 12.

Relief valve 13 is a mechanical pressure governor, which is driven to open when a fuel pressure in fuel gallery pipe 8 exceeds a threshold to return the fuel in fuel gallery pipe 8 into fuel tank 1, to thereby prevent the fuel pressure in fuel gallery pipe 8 from being increased to exceed the threshold.

An electronic control unit 11 incorporating therein a microcomputer outputs an injection pulse signal to each fuel injection valve 9, to thereby control a fuel injection amount and injection timing of each fuel injection valve 9.

Further, electronic control unit 11 controls a duty of a pulse width modulation (PWM) signal for fuel pump 4, to thereby control a discharge amount of fuel pump 4.

The above duty is a manipulated variable for fuel pump 4 in the present embodiment.

Furthermore, electronic control unit 11 outputs an opening control signal to an electronically controlled throttle 27 for driving a throttle valve by a motor, to thereby control an intake air amount of engine 10.

Electronic control unit 11 inputs thereto detection signals that are delivered from various sensors.

With regard to the various sensors, there are disposed an air flow meter 21 capable of detecting an intake air flow amount of engine 10, a crank angle sensor 22 capable of outputting a signal at each reference crank angle position, a water temperature sensor 23 capable of detecting the cooling water temperature Tw of engine 10, a pressure sensor 24 capable of detecting the fuel pressure in fuel gallery pipe 8, a fuel temperature sensor 25 capable of detecting the temperature of the fuel in fuel gallery pipe 8, an air-fuel ratio sensor 26 capable of detecting an air-fuel ratio based on oxygen concentration in exhaust gas of engine 10, and the like.

Then, electronic control unit 11 calculates injection pulse width, based on the detection signals detected from air flow meter 21, crank angle sensor 22, water temperature sensor 23, air-fuel ratio sensor 26 and the like. Further, since the injection amount per unit opening time of fuel injection valve 9 is changed depending on the fuel pressure in fuel gallery pipe 8, electronic control unit 11 adjusts the injection pulse width based on the fuel pressure at the time.

Further, electronic control unit 11 calculates the duty of the PWM signal for fuel pump 4, so that the fuel pressure detected by pressure sensor 24 approaches a target pressure. The target pressure is set at 350 kPa for example.

Furthermore, electronic control unit 11 has a function of determining whether pressure sensor 24 is in a normal operation state or in an abnormal operation state. Thus, when pressure sensor 24 is determined to be in the abnormal state, electronic control unit 11 executes controlling of fuel pump 4 without using the detection result by pressure sensor 24.

Figure 2:
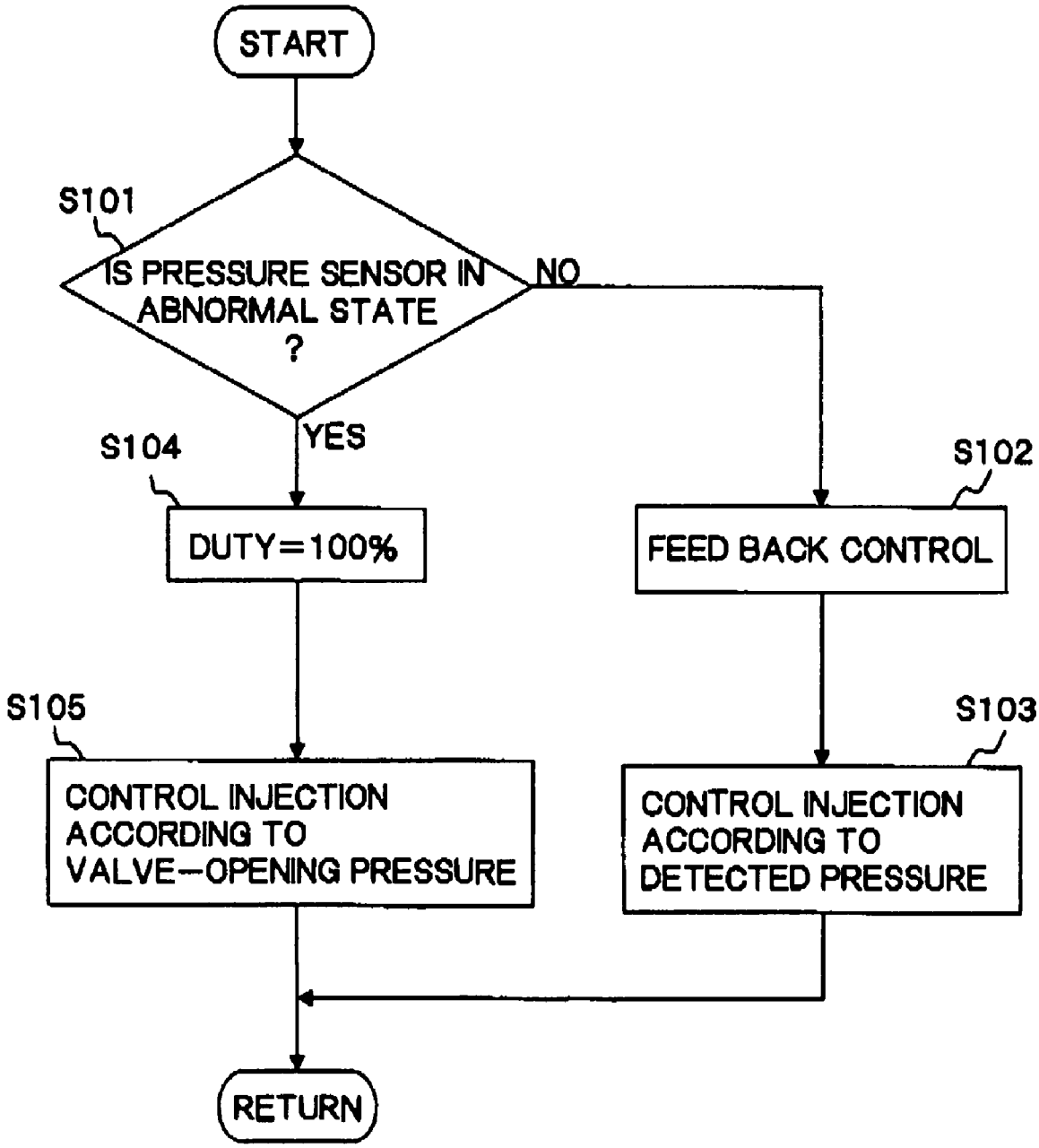
FIG. 2 is a flowchart showing a first embodiment of a pump controlling for a case where a pressure sensor falls in an abnormal operation state due to failure.

A flowchart of FIG. 2 shows a first embodiment of a pump controlling for when pressure sensor 24 is in the abnormal operation state.

In the flowchart of FIG. 2, in step S101, it is determined whether pressure sensor 24 is in the normal operation state or in the abnormal operation state.

The determination of the normality/abnormality of pressure sensor 24 is performed based on whether or not a sensor output is within a normal range, as described later. However, the determining method thereof is not restricted thereto and known various types of determining methods can be used.

And then, if pressure sensor 24 is in the normal state, the routine proceeds to step S102, where the duty of the PWM signal for fuel pump 4 is calculated based on the deviation between the pressure detected by pressure sensor 24 and the target pressure.

In the next step S103, the injection pulse width of fuel injection valve 9 is calculated based on the fuel pressure detected by pressure sensor 24, to thereby control fuel injection valve 9 based on the calculated injection pulse width.

On the other hand, when it is determined in step S101 that pressure sensor 24 is in the abnormal operation state, if fuel pump 4 and fuel injection valve 9 are controlled based on the detection result of pressure sensor 24, the fuel pressure cannot be controlled at the target pressure, and also, the fuel of required amount cannot be injected from fuel injection valve 9.

Therefore, when it is determined that pressure sensor 24 is in the abnormal operation state, the routine proceeds to step S104, where a feedback control of fuel pump 4 using the detection result of pressure sensor 24 is inhibited and the duty of the PWM signal for fuel pump 4 is fixedly maintained at 100%.

If the duty is fixedly maintained at 100%, fuel pump 4 is controlled to discharge the fuel of maximum discharge amount, and therefore, the fuel pressure in fuel gallery pipe 8 is increased.

However, when the fuel pressure exceeds a valve-opening pressure (for example 810 kPa) in relief valve 13, since relief valve 13 is opened to return the fuel into fuel tank 1, the pressure in fuel gallery pipe 8 is held in the vicinity of the valve-opening pressure.

Namely, in the state where the duty is fixedly maintained at 100%, the fuel pressure in fuel gallery pipe 8 can be estimated to be in the vicinity of the valve-opening pressure.

Therefore, in the next step S105, it is assumed that the fuel pressure in fuel gallery pipe 8 is held in the vicinity of the valve-opening pressure, and the injection pulse width is set so that a required fuel amount can be injected under such a pressure condition.

Namely, the valve-opening pressure is previously stored and the injection pulse width is set based on the stored valve-opening pressure.

According to the above described control, it is possible to increase the fuel pressure in fuel gallery pipe 8 up to the vicinity of the valve-opening pressure to hold it without being influenced by the fuel pressure at the time when pressure sensor 24 is failed.

Further, fuel injection valve 9 injects the fuel with the injection pulse width corresponding to the valve-opening pressure, so that the required fuel amount of engine 10 can be injected at a high accuracy.

Thus, even if pressure sensor 24 is failed, it is possible to control the fuel pressure at a given value to thereby determine the fuel injection pulse width, so that the required fuel amount of engine 10 can be injected from fuel injection valve 9.

Furthermore, since the pressure in fuel gallery pipe 8 is made higher, the generation of fuel vapor can be reduced, and the required fuel amount can be stably injected even in a high load region of engine 10.

Figure 3:
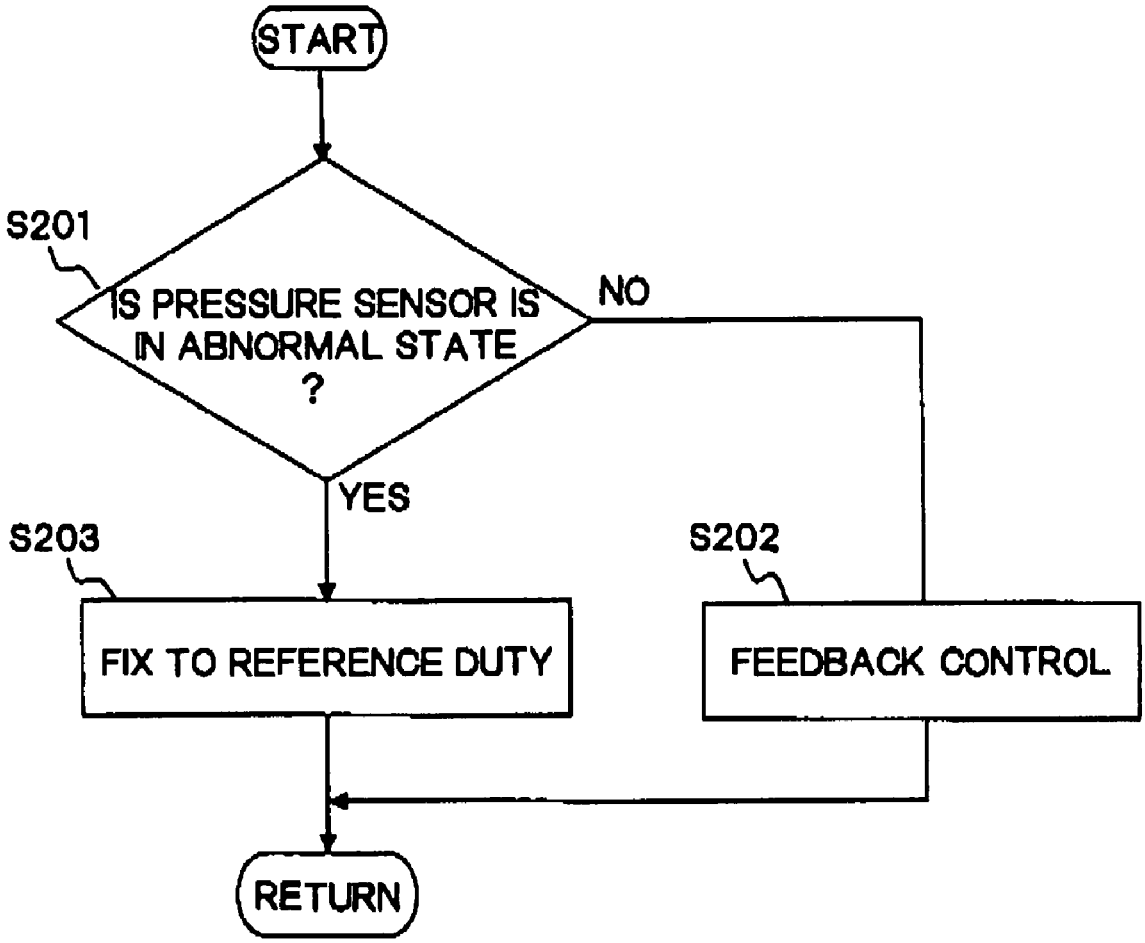
FIG. 3 is a flowchart showing a second embodiment of the pump controlling for a case where a pressure sensor falls in an abnormal operation state due to failure.

A flowchart of FIG. 3 shows a second embodiment of the pump controlling for when pressure sensor 24 is in the abnormal state.

In the flowchart of FIG. 3, in step S201, it is determined whether pressure sensor 24 is in the normal operation state or in the abnormal operation state.

If pressure sensor 24 is in the normal operation state, the routine proceeds to step S202, where the duty of the PWM signal for fuel pump 4 is normally feedback controlled based on the deviation between the fuel pressure detected by pressure sensor 24 and the target pressure.

The above target pressure is set at 350 kPa for example.

On the contrary, when pressure sensor 24 falls in the abnormal operation state, the routine proceeds to step S203, where the duty of the PWM signal for fuel pump 4 is fixedly maintained at a reference duty beforehand stored in electric control unit 11.

The reference duty is that capable of obtaining a rotating force corresponding to the target pressure in the feedback control, and 0%<reference duty<100%.

Further, in the state where the duty is fixedly maintained at the reference duty, it is assumed that the fuel pressure is controlled at the target pressure in the feedback control in step S202, and the injection pulse width is calculated.

In the case where the duty is fixedly maintained at the reference duty, the fuel pressure cannot be high accurately controlled to become the target pressure, and further, there is such a possibility that a large pressure error occurs due to the lack of discharge amount particularly in a high load and high rotation region. However, it is attempted to increase the fuel pressure in the vicinity of the target pressure to hold it, and therefore, it is possible to ensure the necessary and sufficient driving performance as the driving performance for when pressure sensor 24 is in the abnormal state.

Incidentally, if the reference duty is adjusted depending on a change in the temperature of fuel at the moment of time, a more highly accurate control of the fuel pressure can be achieved with certainty.

In the case where the control duty for fuel pump 4 is fixedly maintained at the reference duty, if the engine operation continues to be performed in the high load and high rotation region where a required fuel flow amount is large, since the discharge amount of fuel pump 4 is smaller than the required fuel flow amount, sometimes, the fuel pressure is significantly lower than the target pressure.

In this case, if the injection pulse width is determined on the assumption that the fuel pressure reaches the target pressure, the fuel amount actually injected becomes smaller than the required fuel amount, resulting in that the air-fuel ratio becomes leaner.

Therefore, in the following, in the case where pressure sensor 24 is failed and the duty of the PWM signal is fixedly maintained at the reference duty, an engine control for preventing the air-fuel ratio from becoming leaner will be described in accordance with a flowchart of FIG. 4.

Figure 4:
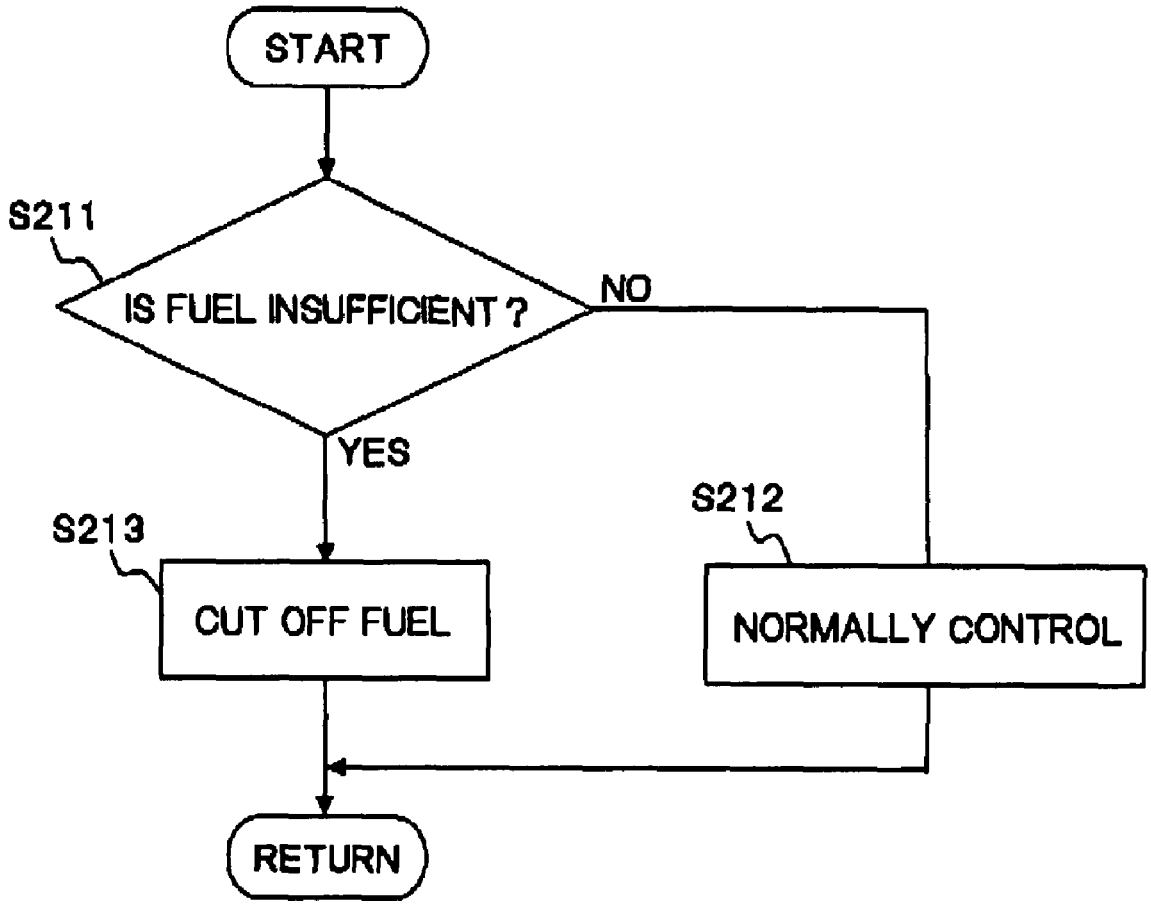
FIG. 4 is a flowchart showing a fuel cut-off controlling which is executed simultaneously with the pump controlling of the second embodiment.

The engine control shown in the flowchart of FIG. 4 is for restricting the operation of engine 10 under a condition that the discharge amount of fuel pump 4 is insufficient for the required fuel flow amount of engine 10.

The flowchart of FIG. 4 is executed in the case where the duty of the PWM signal for fuel pump 4 is fixedly maintained at the reference duty, and firstly, in step S211, it is determined whether or not the fuel amount is insufficient based on a required fuel injection amount in fuel injection valve 9, the engine rotating speed and the control duty for fuel pump 4.

Here, it is possible to obtain the required fuel flow amount of engine 10 based on both the required fuel injection amount in fuel injection valve 9 and the engine rotating speed, and therefore, it is determined whether or not the control duty for fuel pump 4 is necessary and sufficient for the required fuel flow amount.

And then, if the fuel amount is not insufficient, the routine proceeds to step S212, where engine 10 is normally operated.

On the other hand, if the fuel amount is insufficient, the routine proceeds to step S213, where the fuel injection by fuel injection valve 9 is forcibly stopped.

Namely, the operation of engine 10 is inhibited in the high load and high rotation region where the fuel amount is insufficient, and engine 10 is operated only in a low load and low rotation region where the fuel amount is sufficient.

Accordingly, engine 10 is not operated in the region where the fuel pressure is lowered due to the lack of discharge amount of fuel pump 4 and accordingly the required fuel amount cannot be injected, and therefore, the operation in a lean air-fuel ratio can be avoided.

Figure 5:
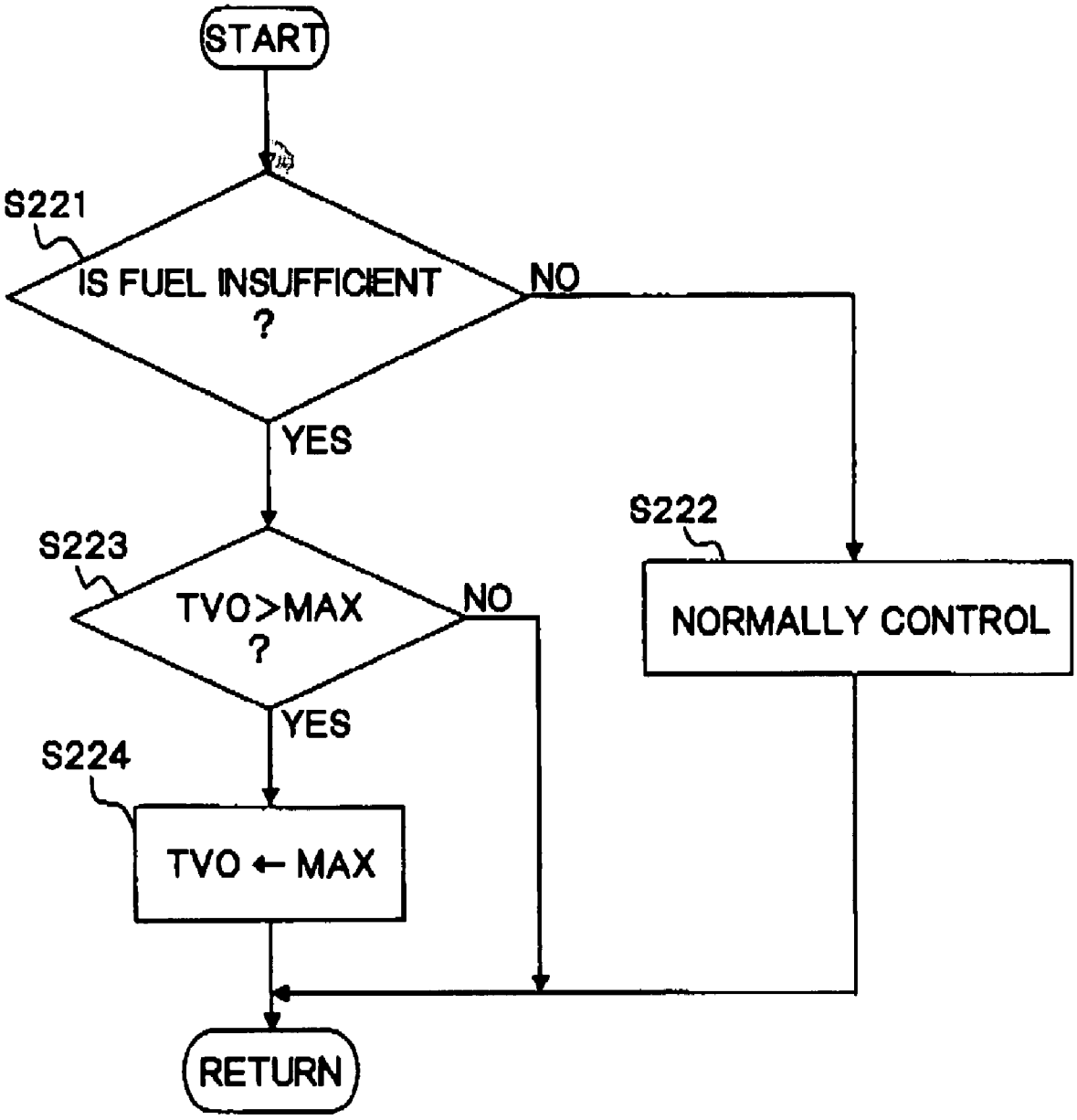
FIG. 5 is a flowchart showing a controlling operation for restriction of a throttle opening which is executed simultaneously with the pump controlling of the second embodiment.

A flowchart of FIG. 5 shows another embodiment for restricting the engine operation under the condition that the discharge amount of fuel pump 4 is insufficient.

The flowchart of FIG. 5 is executed in the case where the duty of the PWM signal for fuel pump 4 is fixedly maintained at the reference duty, and in step S221, it is determined whether or not the fuel amount is insufficient based on the required fuel injection amount in fuel injection valve 9, the engine rotating speed and the control duty for fuel pump 4.

And then, if the fuel amount is not insufficient, the routine proceeds to step S222, where the engine is normally operated without any restriction.

On the other hand, if the fuel amount is insufficient, the routine proceeds to step S223, where it is determined whether or not the target opening TVO of electronically controlled throttle 27 exceeds an upper limit value MAX.

In the case where the target opening TVO of electronically controlled throttle 27 exceeds the upper limit value MAX, the routine proceeds to step S224, where the upper limit value MAX is set at the target opening TVO.

Therefore, it is avoided that the throttle opening is controlled to exceed the upper limit value MAX.

On the other hand, if the target opening TVO of electronically controlled throttle 27 is equal to or less than the upper limit value MAX, the routine bypasses step S224 so as not to limit the target opening TVO.

By limiting the target opening TVO of electronically controlled throttle 27 to the upper limit value MAX or less, the intake air amount of engine 10 is limited, and therefore, a maximum value of the required injection amount becomes smaller.

As a result, it is possible to prevent the operation of engine 10 in the region where the discharge amount of fuel pump 4 is insufficient.

Accordingly, as described in the above, by restricting the throttle opening, it is possible to avoid the operation of engine 10 in the lean air-fuel ratio.

Figure 6:
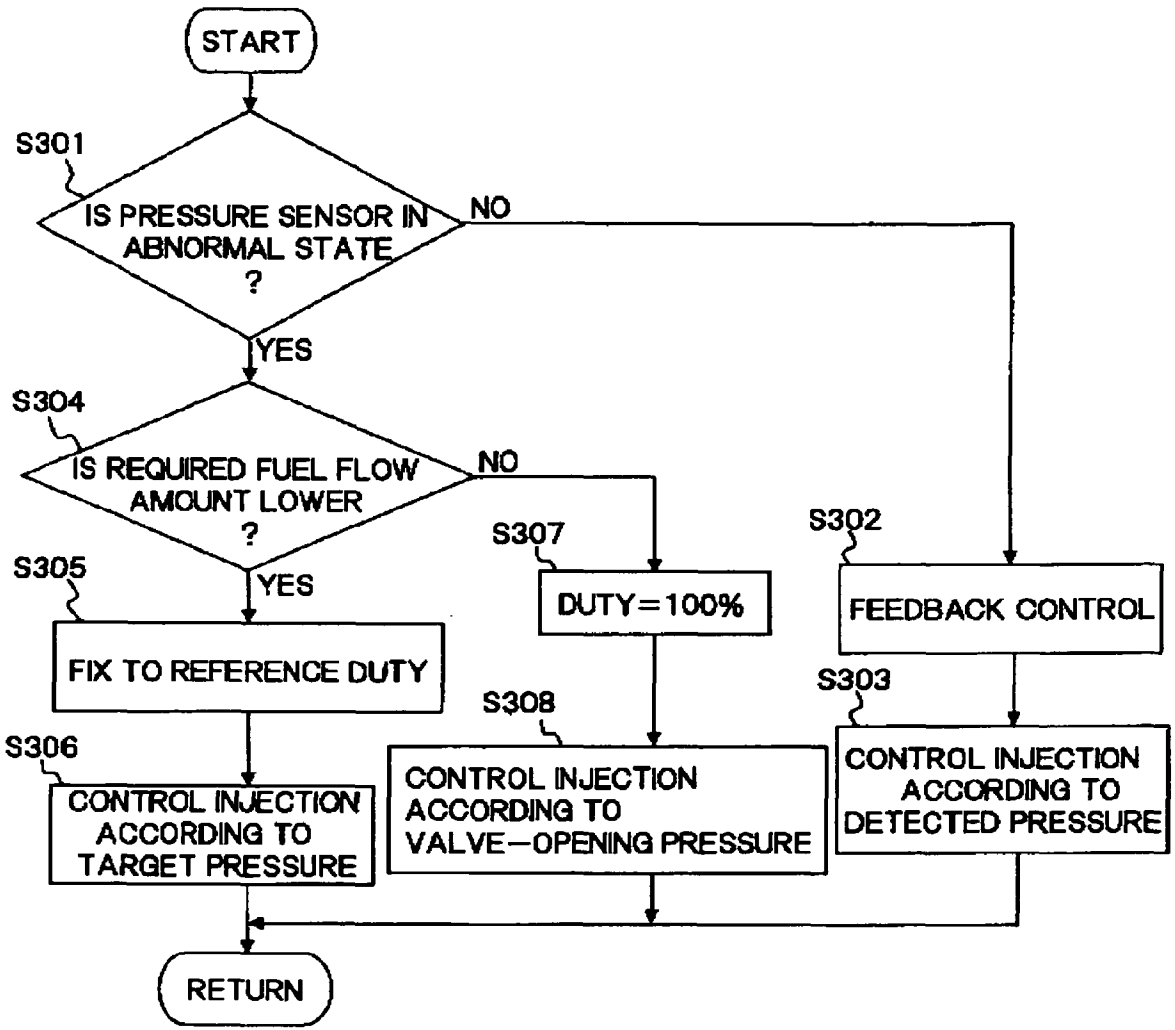
FIG. 6 is a flowchart showing a third embodiment of the pump controlling for a case where a pressure sensor falls in an abnormal operation state due to failure.

A flowchart of FIG. 6 shows a third embodiment of the pump controlling for when pressure sensor 24 is in the abnormal state.

In the flowchart of FIG. 6, in step S301, it is determined whether pressure sensor 24 is in the normal operation sate or in the abnormal operation state.

And then, if pressure sensor 24 is in the normal state, the routine proceeds to step S302, where the discharge amount of fuel pump 24 is feedback controlled based on the deviation between the fuel pressure detected by pressure sensor 24 and the target pressure.

In next step S303, the injection pulse width of fuel injection valve 9 is calculated based on the fuel pressure detected by pressure sensor 24, thereby driving to control fuel injection valve 9 based on the calculated injection pulse width.

On the other hand, if it is determined in step S301 that pressure sensor 24 is in the abnormal state, the routine proceeds to step S304.

In step S304, it is determined whether or not the required fuel flow amount of engine 10 is equal to or less than a predetermined amount, based on both the required fuel injection amount of fuel injection valve 9 and the engine rotating speed.

And then, if the required flow amount of fuel in engine 10 is equal to or less than the predetermined amount, the routine proceeds to step S305. Incidentally, in the case where engine 10 is operated in the low load and low rotation region, since the required fuel flow amount of engine 10 is equal to or less than the predetermined amount, it is possible to determine in step S304 whether or not engine 10 is operated in a predetermined low load and low rotation region.

In step S305, the duty of the PWM signal for fuel pump 4 is fixedly maintained a reference duty beforehand stored in electric control unit 11.

The reference duty, similar to step S203, is that capable of obtaining a rotating force corresponding to the target pressure (350 kPa) in the feedback control in step S202 in a reference operating state of engine 10.

In next step S306, it is assumed that the actual pressure reaches the target pressure, and the injection pulse width of fuel injection valve 9 is normally calculated.

On the other hand, in the case where engine 10 is operated in the high load and high rotation region and the required fuel flow amount of engine 10 exceeds the predetermined amount, the routine proceeds to step S307.

In step 8307, the duty of the PWM signal for fuel pump 4 is fixedly maintained at 100%.

In next step S308, it is assumed that the fuel pressure in fuel gallery pipe 8 is held at the valve-opening pressure of relief valve 13, and the injection pulse width is set so that the required fuel amount can be injection under such a pressure condition.

According to the above embodiment, since fuel pump 4 is driven by the reference duty in the low load and low rotation region of engine 10, it is possible to prevent engine 10 from being operated under the condition that the discharge amount of fuel pump 4 is insufficient for the required fuel flow amount, while suppressing the power consumption in fuel pump 4.

Further, it is possible to maintain the measuring accuracy in the region where the fuel injection amount is small, by restricting the fuel pressure to be lower in the low load and low rotation region.

On the other hand, since the control duty for fuel pump 4 is fixedly maintained at 100% in the high load and high rotation region where the required fuel flow amount of engine 10 is large, it is possible to ensure the discharge amount exceeding the required fuel flow amount in the high load and high rotation region, to thereby operate engine 10 in the whole operating region.

Incidentally, the starting time of engine 10 operation can be added as a condition for fixedly maintaining the duty at 100%.

Figure 7:
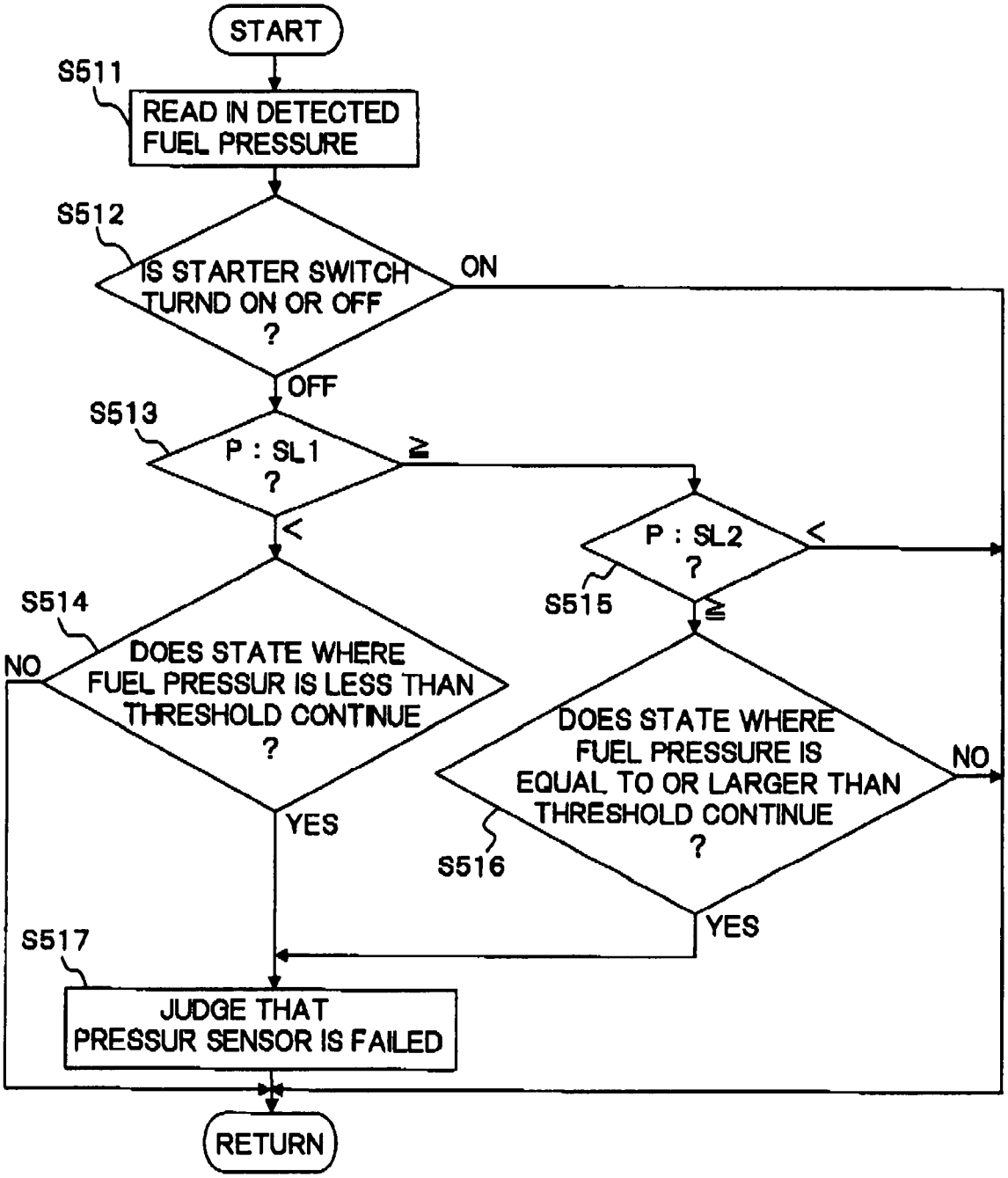
FIG. 7 is a flowchart showing the failure determine of the pressure sensor.

A flowchart of FIG. 7 shows the abnormal determination of pressure sensor 24.

In step S511, the fuel pressure P detected by pressure sensor 24 is read in.

In step S512, it is determined whether a starter switch for engine 10 is turned ON or OFF.

And then, when the operation of engine 10 has been started (starter switch was turned OFF), the routine proceeds to step S513, where it is determined whether or not the fuel pressure read in step S511 is equal to or larger than a threshold SL1.

The threshold SL1 is previously stored as a value below which the detection result of fuel pressure sensor 24 is not lowered when fuel pressure sensor 24 is in the normal state.

Here, when the fuel pressure P read in step S511 is less than the threshold SL1, the routine proceeds to step S514, where it is determined whether or not a state where the fuel pressure P is less than the threshold SL1 continues for over a predetermined period of time.

And then, in the case where the fuel pressure P is less than the threshold SL1 for over the predetermined period of time, the routine proceeds to step S517, where it is determined that fuel pressure sensor 24 is in the abnormal state.

On the other hand, in the case where, even in the state where the fuel pressure P is less than the threshold SL1, duration of such a state does not reach the predetermined period of time, step S517 is bypassed and the present routine is terminated.

Further, when it is determined in step S513 that the fuel pressure P is equal to or larger than the threshold SL1, the routine proceeds to step S515.

In step S515, it is determined whether or not the fuel pressure P read in step S511 is equal to or less than a threshold SL2.

The threshold S2 is previously stored as a value over which the detection result of fuel pressure sensor 24 does not exceed when fuel pressure sensor 24 is in the normal state, and the threshold SL1 c the threshold SL2.

When it is determined in step S515 that the fuel pressure P is less than the threshold SL2, since the fuel pressure P is within a normal range between the threshold SL1 and the threshold SL2, it is determined that fuel pressure sensor 24 is in the normal state, and the present routine is terminated.

On the other hand, when it is determined in step S515 that the fuel pressure P is equal to or larger than the threshold SL2, the routine proceeds to step S516, where it is determined whether or not a state where the fuel pressure P is equal to or larger than the threshold SL2 continues for over a predetermined period of time.

And then, in the case where the fuel pressure P is equal to or larger than the threshold SL2 for over the predetermined period of time, the routine proceeds to step S517, where it is determined that fuel pressure sensor 24 is in the abnormal state.

On the other hand, in the case where, even in the state where the fuel pressure P is equal to or larger than the threshold SL2, duration of such a state does not reach the predetermined period of time, step S517 is bypassed and the present routine is terminated.

It should be appreciated that the entire contents of Japanese Patent Application No. 2006-124798 filed on Apr. 28, 2006, a priority of which is claimed, are incorporated herein by reference.

While only selected embodiments have been chosen to illustrate the present invention, it will be apparent to those skilled in the art from this disclosure that various changes and modifications can be made herein without departing from the scope of the invention as defined in the appended claims.

Furthermore, the foregoing description of the embodiments according to the present invention is provided for illustration only, and not for the purpose of limiting the invention as defined in the appended claims and their equivalents.

We claim:

1. A fuel supply apparatus for an engine, comprising:

a fuel injection valve capable of injecting fuel to the engine;

a fuel tank capable of storing the fuel for the engine;

a fuel pump capable of supplying the fuel in the fuel tank to the fuel injection valve via a fuel pipe;

a mechanical relief valve capable of returning the fuel in the fuel pipe into the fuel tank when a pressure in the fuel pipe exceeds a threshold;

a pressure sensor capable of detecting a pressure of the fuel in the fuel pipe; and a control unit configured to input thereto a signal detected from the pressure sensor to output therefrom a manipulated variable for the fuel pump, wherein the control unit is configured to determines whether the pressure sensor is in a normal operation state or in an abnormal operation state;

wherein when the pressure sensor is determined to be in the normal operation state, the control unit calculates the manipulated variable so that the fuel pressure detected by the pressure sensor approaches a target pressure; and wherein when the pressure sensor is determined to be in the abnormal operation state, the control unit is configured to fixedly maintain the manipulated variable at a manipulated variable at which a discharge amount of the fuel pump reaches a maximum amount, to thereby hold the fuel pressure in the fuel pipe in the vicinity of a valve-opening pressure of the relief valve.

2. The apparatus according to claim 1, wherein the control unit:

is configured to fixedly maintain the manipulated variable at the manipulated variable at which a discharge amount of the fuel pump reaches the maximum amount, to thereby hold the fuel pressure in the fuel pipe in the vicinity of the valve-opening pressure of the relief valve, when the pressure sensor is in the abnormal operation state and also a required fuel amount of the engine exceeds a threshold; and is configured to fixedly maintain the manipulated variable at a reference manipulated variable which is set beforehand and is lower than the manipulated variable at which the discharge amount of the fuel pump reaches the maximum amount, when the pressure sensor is in the abnormal operation state and also the required fuel amount of the engine is equal to or less than the threshold.

3. The apparatus according to claim 2, further comprising:

a fuel temperature sensor configured to detect a temperature of the fuel in the fuel pipe, wherein the control unit adjusts the reference manipulated variable based on the fuel temperature detected by the fuel temperature sensor.

4. A fuel supply apparatus for an engine, comprising:

a fuel injection valve capable of injecting fuel to the engine;

a fuel tank capable of storing the fuel for the engine;

a fuel pump capable of supplying the fuel in the fuel tank to the fuel injection valve via a fuel pipe;

a relief valve capable of returning the fuel in the fuel pipe into the fuel tank when a pressure in the fuel pipe exceeds a threshold;

a pressure sensor capable of detecting a pressure of the fuel in the fuel pipe; and a control unit configured to input thereto a signal detected from the pressure sensor to output therefrom a manipulated variable for the fuel pump, wherein the control unit is configured to determine whether the pressure sensor is in a normal operation state or in an abnormal operation state;

wherein when the pressure is determined to be in the normal operation state, the control unit is configured to calculate the manipulated variable so that the fuel pressure detected by the pressure sensor approaches a target pressure;

wherein when the pressure sensor is determined to be in the abnormal operation state the control unit is configured to fixedly maintain the manipulated variable at a reference manipulated variable corresponding to a reference fuel pressure; and wherein when the manipulated variable is fixedly maintained at the reference manipulated variable, an operation of the engine under a condition that a fuel supply amount to the engine is insufficient is restricted.

5. The apparatus according to claim 4, wherein the control unit outputs a signal for stopping the fuel injection by the fuel injection valve under a condition that the fuel supply amount is insufficient.

6. The apparatus according to claim 4, wherein the control unit outputs a signal therefrom that restricts the throttle opening in the engine to equal to or less than the predetermined opening under the condition that the fuel supply amount is insufficient.

7. The apparatus according to claim 4, wherein the control unit determines whether or not the fuel supply amount is insufficient, based on a required fuel injection amount by the fuel injection valve, an engine rotating speed and the manipulated variable for the fuel pump.

8. A fuel supply apparatus for an engine, comprising:

fuel injecting means for injecting fuel to the engine;

fuel reserving means for reserving the fuel for the engine;

fuel supplying means for supplying the fuel in the fuel reserving means to the fuel injecting means via a fuel pipe;

mechanical relieving means for returning the fuel in the fuel pipe into the fuel reserving means when a pressure in the fuel pipe exceeds a threshold;

pressure detecting means for detecting a pressure of the fuel in the fuel pipe; and control means for inputting thereto a signal detected from the pressure detecting means to output a manipulated variable for the fuel supply means, wherein the control means is configured to determine whether the pressure detecting means is in a normal state or in an abnormal state;

wherein when the pressure detecting means is in the normal state, the control means is configured to calculate the manipulated variable so that the fuel pressure detected by the pressure detecting means approaches a target pressure; and wherein when the pressure detecting means is in the abnormal state, the control means is configured to fixedly maintain the manipulated variable at a manipulated variable at which a discharge amount of the fuel pump reaches a maximum amount, to thereby hold a fuel pressure in the fuel pipe in the vicinity of a valve-opening pressure of the relief valve.

9. A control method of a fuel supply apparatus for an engine, which is provided with a fuel pump capable of supplying fuel in a fuel tank to a fuel injection valve via a fuel pipe; a mechanical relief valve capable of returning the fuel in the fuel pipe into the fuel tank when a pressure in the fuel pipe exceeds a threshold; and a pressure sensor capable of detecting a pressure of the fuel in the fuel pipe, comprising the steps of:

determining whether the pressure sensor is in the normal operation state or in an abnormal operation state;

calculating, when the pressure sensor is in the normal operation state, a manipulated variable so that the fuel pressure detected by the pressure sensor approaches a target pressure; and fixedly maintaining, when the pressure sensor is determined to be in the abnormal operation state, the manipulated variable at a manipulated variable at which a discharge amount of the fuel pump reaches a maximum amount so that the fuel pressure in the fuel pipe is held in the vicinity of a valve-opening pressure of the relief valve, thereby outputting the maintained manipulated variable to the fuel pump.

10. The method according to claim 9, wherein the step of fixedly maintaining the manipulated variable comprises the steps of:

determining whether or not a required fuel amount of the engine exceeds a threshold;

fixedly maintaining the manipulated variable at a manipulated variable at which a discharge amount of the fuel pump reaches the maximum amount, thereby holding the fuel pressure in the fuel pipe in the vicinity of the valve-opening pressure of the relief valve, when the required fuel amount of the engine exceeds the threshold; and fixedly maintaining the manipulated variable at a reference manipulated variable which is set beforehand and lower than the manipulated variable at which a discharge amount of the fuel pump reaches a maximum amount when the required fuel amount of the engine is equal to or less than the threshold.

11. The method according to claim 10, further comprising the steps of:

detecting a temperature of the fuel in the fuel pipe; and adjusting the reference manipulated variable based on the fuel temperature.

12. A control method of a fuel supply apparatus for an engine, which is provided with a fuel pump capable of supplying fuel in a fuel tank to a fuel injection valve via fuel pipe; a relief valve capable of returning the fuel in the fuel pipe in to the fuel tank when a pressure in the fuel pipe exceeds a threshold; and a pressure sensor capable of detecting a pressure of the fuel in the fuel pipe, comprising the steps of:

determining whether the pressure sensor is in a normal operation state or in an abnormal operation state;

calculating, when the pressure sensor is in the normal operation state, a manipulated variable so that the fuel pressure detected by the pressure sensor approaches a target pressure;

fixedly maintaining, when the pressure sensor is in the abnormal operation state, a manipulated variable at a reference manipulated variable that corresponds to a reference fuel pressure set before hand;

outputting the maintained manipulated variable to the fuel pump; and restricting an operation of the engine under a condition that a fuel supply amount to the engine is insufficient, when the manipulated variable is fixedly maintained at the reference manipulated variable that corresponds to the reference fuel pressure.

13. The method according to claim 12, wherein the step of restricting the operation of the engine comprises the step of;

outputting a signal stopping the fuel injection by the fuel injection valve under a condition that the fuel supply amount is insufficient.

14. The method according to claim 12, wherein the step of restricting the operation of the engine comprises the step of;

outputting a signal restricting the throttle opening in the engine to equal to or less than the predetermined opening under a condition that the fuel supply amount is insufficient.

15. The method according to claim 12, wherein the step of restricting the operation of the engine comprises the steps of:

detecting a required fuel injection amount in the fuel injection valve;

detecting an engine rotating speed;

detecting the manipulated variable for the fuel pump; and determining whether or not the fuel supply amount is insufficient based on the required fuel injection amount in the fuel injection valve, the engine rotating speed and the manipulated variable for the fuel pump.

16. A fuel supply apparatus for an engine, comprising:

fuel injecting means for injecting fuel to the engine;

fuel reserving means for reserving the fuel for the engine;

fuel supplying means for supplying the fuel in the fuel reserving means to the fuel injecting means via a fuel pipe;

relieving means for returning the fuel in the fuel pipe into the fuel reserving means when a pressure in the fuel pipe exceeds a threshold;

pressure detecting means for detecting a pressure of the fuel in the fuel pipe; and control means for inputting thereto a signal detected from the pressure detecting means to output a manipulated variable for the fuel supply means, wherein the control means is configured to determine whether the pressure detecting means is in a normal state or in an abnormal state;

wherein when the pressure detecting means is in the normal state, the control means is configured to calculate the manipulated variable so that the fuel pressure detected by the pressure detecting means approaches a target pressure;

wherein when the pressure detecting means is in the abnormal state, the control means is configured to fixedly maintain the manipulated variable at a reference manipulated variable that corresponds to a reference fuel pressure; and wherein when the manipulated variable is fixedly maintained at the reference manipulated variable, an operation of the engine under a condition that a fuel supply amount to the engine is insufficient is restricted.

* * * * *